US005161736A

United States Patent [19]

Roccoberton et al.

[11] Patent Number: 5,161,736

[45] Date of Patent: Nov. 10, 1992

[54] LOCKING CURRENCY STACKER APPARATUS AND METHOD

[75] Inventors: Todd Roccoberton, Riverdale; Louis De Feo, South Orange, both of N.J.

[73] Assignee: Bloomfield Manufacturing Co., Fairfield, N.J.

[21] Appl. No.: 719,772

[22] Filed: Jun. 24, 1991

[51] Int. Cl.[5] ..... G07B 15/00

[52] U.S. Cl. ..... 232/15

[58] Field of Search ..... 232/15, 31, 43.2; 194/350; 221/197, 154, 287; 109/45, 46, 50, 51, 66

[56] References Cited

U.S. PATENT DOCUMENTS

| | | | |
|---|---|---|---|
| 3,841,550 | 10/1974 | Kaneda et al. | 232/15 |
| 3,843,043 | 10/1974 | Sciortino | 232/15 |
| 3,854,655 | 12/1974 | Armstrong | 232/4 R |
| 3,917,260 | 11/1975 | Okkonen et al. | 271/181 |
| 3,948,376 | 4/1976 | Roman | 232/15 |
| 4,045,017 | 8/1977 | Lundblad | 271/181 |
| 4,113,140 | 9/1978 | Graef et al. | 221/6 |
| 4,399,903 | 8/1983 | McDonald | 232/15 |
| 4,434,931 | 3/1984 | Hunt et al. | 232/15 |
| 4,678,072 | 7/1987 | Kobayashi et al. | 194/206 |
| 4,720,092 | 1/1988 | Juleff | 271/207 |
| 4,834,230 | 5/1989 | Kondo et al. | 194/206 |
| 4,913,341 | 4/1990 | Bachman | 232/15 |
| 4,949,901 | 8/1990 | Harris | 232/15 |

FOREIGN PATENT DOCUMENTS

| | | | |
|---|---|---|---|
| 238481 | 1/1961 | Australia | 232/15 |
| 357458 | 8/1922 | Fed. Rep. of Germany | 232/15 |

*Primary Examiner*—Renee S. Luebke
*Assistant Examiner*—Michael J. Milano
*Attorney, Agent, or Firm*—Richard N. Miller

[57] ABSTRACT

A locking currency stacker apparatus for use in conjunction with currency validation apparatus having a plunger for transferring currency through a passage into a currency receptacle and either having or adaptable to having pivot means adjacent to one end of the transfer passage which comprises (a) an open currency receptacle having a slideway for a cover adjacent the opening; (b) a separate cover for said receptacle; (c) means for locking said cover on said receptacle and for unlocking same therefrom; (d) means for removably attaching said receptacle to the currency validation apparatus which comprise (1) hook means on said receptacle for engaging pivot means on said validation apparatus and (2) latching means on said receptacle; and (e) an adapter bracket unit which includes cooperating strike means for said latching means and which is attached to the currency validation apparatus; whereby the step of closing said receptacle by seating said cover in the slideways of said receptacle simultaneously locks said cover on the receptacle and unlatches one end of the locked currency stacker receptacle from the currency validation apparatus so that said locked currency receptacle may be removed therefrom by disengaging the hook means from the pivot means.

Also within the scope of the invention is a method of converting currency validation and collection apparatus having said plunger and said pivot means adjacent to the passage for currency transfer comprising the steps of (A) removing the unlockable receptacle from the validation and collection apparatus; (B) attaching an adapter bracket unit to the validation apparatus adjacent to the end of the transfer passage opposite the pivot means; and (C) installing thereon the inventive locking currency stacker receptacle.

19 Claims, 6 Drawing Sheets

LOCKING CURRENCY STACKER APPARATUS AND METHOD

The present invention relates to a locking currency stacker apparatus and more particularly to a currency stacker which is removably attached to an electro-mechanical currency validator by means of an adapter bracket unit and released therefrom by means of a slide key cover which unlatches one end of the collector apparatus from the validation apparatus for removal therefrom by unhooking the other end and maintains the collector in locked condition until unlocked by the cashier. The term "currency" as used herein refers to paper money in circulation.

BACKGROUND OF THE INVENTION

At present, many of the currency collectors used in conjunction with the electro-mechanical currency validator apparatus employed in vending machines which accept one, five, ten and twenty dollar bills in exchange for an equivalent value in coins, products or services are subject to pilferage because the currency collectors do not have a locking cover. In fact, typically the currency collector is accessible during the servicing of the validation apparatus and is not covered at the time the collector filled with currency is removed from the validator apparatus by the route person and emptied. An example of an open collector is shown in U.S. Pat. No. 3,917,260. Thus, these unlocked currency-containing collectors are subject to pilfering by the route person and other persons involved in the collection process.

Typically, the electro-mechanical currency validator apparatus used in conjunction with the unlocked currency collectors has a plunger for transferring currency through a passage to the collection receptacle after the currency has been accepted and validated. Further, such apparatus either has or is adaptable to having pivot means adjacent to one end of the passage. In such apparatus, after validation, currency, e.g., dollar bills, is delivered lengthwise to a space in front of the plunger which is reciprocated in response to a signal from the currency acceptor-validator to move the currency through the open end of the stacker receptacle so that currency which is fed sequentially to the validator apparatus is collected in a stack in the currency stacker receptacle.

In one attempt to overcome the problem of unlocked currency collectors, a currency collector having a locking cover has been introduced. The locked collector has a circular cross-section and is locked by rotating an internal partial cylinder from an open position to a closed position using a key operated external lock which coacts with a second lock on the collector. The external lock is designed to cooperate with the lock on the collector to rotate the internal cylinder to the locked position and to disengage the collector lock device from the external lock, thereby releasing the locked currency collector from the bracket carrying the external lock. In installing this currency collector, the external lock engages the lock on the empty replacement collector and rotates the internal cylinder to the open position while simultaneously engaging the internal and external locks to secure the collector to the bracket. However, this collector has found very limited commercial acceptance, apparently because the collected currency interferes with rotation of the internal cylinder so as to render the apparatus inoperable. Furthermore, it appears that this collector is not well protected against pilferage during mechanical servicing of the currency validation apparatus because currency can be removed by removing fasteners from the pivot bar.

Other attempts to eliminate the problem of open or unlocked currency collector receptacles have involved complete replacement of both the currency validator and stacking apparatus. For example, U.S. Pat. No. 4,834,230 discloses a combination currency validator and collector apparatus wherein the currency collector is closed with a locking cover prior to the removal of the currency collector therefrom. U.S. Pat. No. 4,434,931, too, discloses a different type of combination currency validator and collector apparatus wherein the currency collector is closed with a cover which is locked in place prior to separation of the currency collector from the currency validator. However, the redesign of the combined validator-collector apparatus to achieve a locked currency collector is expensive because the collector is only one part of the combined apparatus and this method of attaining a covered and locked collector tends to be complex in design and operation.

An alternative to the solution of the problem by redesigning the combination collection apparatus is the apparatus shown in U.S. Pat. No. 4,720,092 wherein the plunger for transferring currency is included as part of the currency stacker receptacle. This approach is complex and expensive, too, because the plunger unit and means of operating same are included within the locked currency receptacle.

The foregoing discussion indicates that there is a need for a locked or lockable currency collector which is inexpensive, simple in design and can be used in conjunction with currency validation apparatus currently in use.

SUMMARY OF THE INVENTION

In accordance with the present invention, a novel locking currency stacker apparatus is provided which includes an adapter bracket unit and an open currency receptacle which is covered by a locking-unlocking cover sliding in cover slideways adjacent to the opening in the receptacle. The cover functions as a slide key which locks said cover to the currency containing receptacle and simultaneously unlatches the locked currency receptacle from the currency validation apparatus when the cover is seated fully on said receptacle. Further, the novel inventive apparatus is easy to install on currency validation machines presently in use which have a plunger for transferring currency and either have or are adaptable to having pivot means adjacent to the plunger, is relatively trouble-free in use because the currency does not interfere with the cover, is secure against pilfering during servicing, is relatively inexpensive and is removed from the currency validation apparatus with the currency locked in a receptacle which is to be opened by the cashier at a central counting facility. Also included within the scope of the invention is a method of converting currency validation apparatus from use of unlocked receptacles to locked receptacles.

Generally, the inventive locking currency stacker apparatus for use in conjunction with the aforementioned currency validation apparatus comprises (a) an open currency receptacle having slideways for a cover adjacent the opening, (b) a separate cover for said receptacle; (c) means for locking said cover on said receptacle and for unlocking same therefrom; (d) means for removably attaching said receptacle to the currency validation apparatus which comprise (1) hook means on said receptacle for pivot means on said validation apparatus and (2) latching means on said receptacle; and (e) an adapter bracket unit which includes cooperating strike means for said latching means and is attachable to the currency validation apparatus adjacent to the other end of the currency transfer passage; whereby the step of closing said receptacle by seating said cover in the slideways of said receptacle simultaneously locks said cover on the receptacle and unlatches one end of the locked currency receptacle from the currency validation apparatus so that said locked currency receptacle may be removed therefrom by disengaging the hook means from the pivot means.

In a preferred aspect, the means for locking and unlocking said cover on said receptacle include a movable slide bar and a key operated unlocking device, both of which are located on said receptacle; and said receptacle further includes a follower plate and spring means therein which biase the follower plate toward the open end of the receptacle to facilitate stacking said currency.

In a more preferred aspect, the currency receptacle further includes a protector which covers an end of the pivot means fastened to the currency validation apparatus with an exposed fastener to deter removal of said pivot bar; and one end of said receptacle is a hinged door which is maintained in closed position by locking cam means on a key operated unlocking device, said locking cam means being effective to open said door while simultaneously moving said slide bar to unlock said cover.

As indicated, the invention also includes a method of converting a combination currency validation and collection apparatus having a plunger for transferring currency from the validator to the collector and either having or adaptable to having pivot means adjacent to one end of the passage through which the currency is transferred from use of an unlockable currency receptacle to a locking currency receptacle comprising the steps of: (A) removing the original unlockable currency receptacle from the validation and collection apparatus; (B) attaching an adapter bracket unit with cooperating strike means to the validation apparatus adjacent the end of the transfer passage opposite the end thereof adjacent to the pivot means; and (C) installing thereon an open replacement currency receptacle having (1) a slideway adjacent the opening; (2) a separate cover; (3) means for locking and unlocking said cover on the receptacle; and (4) means for removably attaching said receptacle to said bill validation apparatus which comprise hook means for said pivot means and latching means which cooperate with said strike means to latch said receptacle to said validation apparatus; whereby the step of seating said cover fully in said slideway simultaneously locks said cover on said receptacle and unlatches one end of said receptacle from said validation apparatus to facilitate removal of same by unhooking the other end of said receptacle from the pivot means.

The inventive currency stacker apparatus is simple in design and can be incorporated into the standard currency validation apparatus which includes a currency transfer plunger and pivot means adjacent the currency transfer passage with a minimum of effort using tools in possession of the servicing person. The preferred currency collector apparatus is positively hooked to the pivot bar or pivot points of the currency validation apparatus, thereby minimizing the possibility of the dropping the unit during installation. Also, the currency collector apparatus is latched to said validation apparatus using a smooth swinging action. Nothing other than a replacement currency stacker apparatus and the slide key cover are required to substitute an empty currency receptacle for a filled receptacle. The capacity of the receptacle is variable and currency is readily accessible for counting when the cover is removed and the door is opened, both actions being accomplished by simply turning a key in the key unlocking device.

The so-called standard currency validation apparatus which can utilize the inventive currency stacker apparatus is characterized by a currency transfer plunger and either pivot means, e.g., a pivot bar or pivot points, adjacent to one end of the currency transfer passage or adaptable to being modified to include said pivot means at said location. More specifically, the compatible validation apparatus includes, but is not limited to, Rowe International Model CBA-2 (Rowe), Mars Electronics Model VFN 5S-L-1-D-40 (Mars), Dixie Narco, Inc., Up Stack Acceptor (Dixie K) and Maka Corporation Model No. NB-15A-200 (Maka). Because the compatible validation apparatus is made by four manufacturers, the validation apparatus differs in details according to the manufacturer. For example, each of Rowe and Mars validation apparatus has a pivot bar, the Maka has pivot points and the Dixie is adaptable to the addition of a pivot bar. Further, each of the Rowe, Dixie and Maka has an end bracket adjacent to the end of the currency transfer passage which is opposite the pivot means and, therefore, the adapter bracket unit of the inventive apparatus either can be fastened thereto or substituted therefor. On the other hand, the Mars has no end bracket and the inventive adapter bracket unit forms an end bracket for the validation apparatus. In addition, to combine the inventive apparatus with the Maka validation unit, the plastic lower currency guide with two spring tensioned rollers on each side of the currency transfer passage must be removed from the Maka and be reattached to the side of the receptacle in the inventive apparatus and a microswitch bracket must be included on said receptacle. In practice, the plastic lower currency guide of the Maka is installed on the inventive replacement receptacle prior to delivery to the serviceman and the lower plastic guide is removed from the Maka validation apparatus and returned to the factory by the serviceman.

BRIEF DESCRIPTION OF THE DRAWINGS

Several preferred embodiments of the locking currency stacker apparatus of this invention are illustrated in the accompanying drawings in which.

BRIEF DESCRIPTION OF THE DRAWINGS

Figure 1:
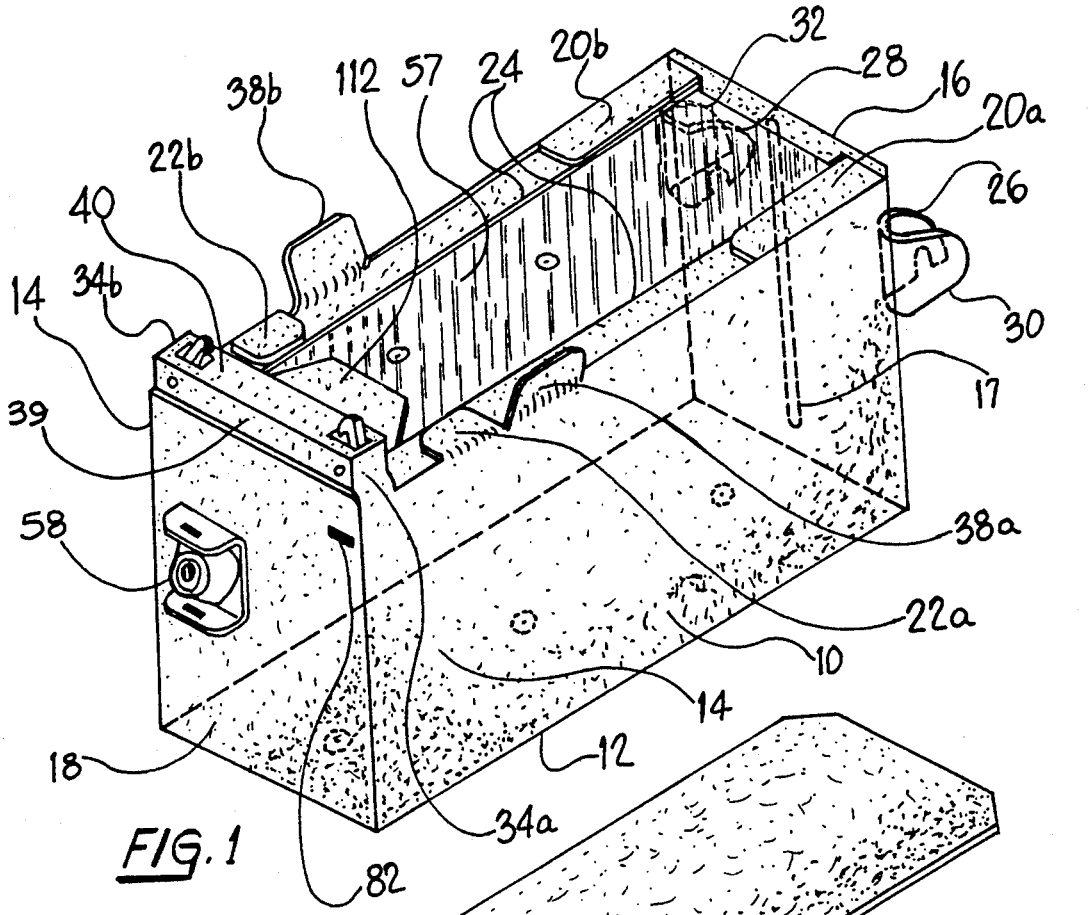
FIG. 1 is an isometric view of the replacement currency stacker receptacle without a cover which is particularly suitable for use with the Rowe validation apparatus.
Figure 2:
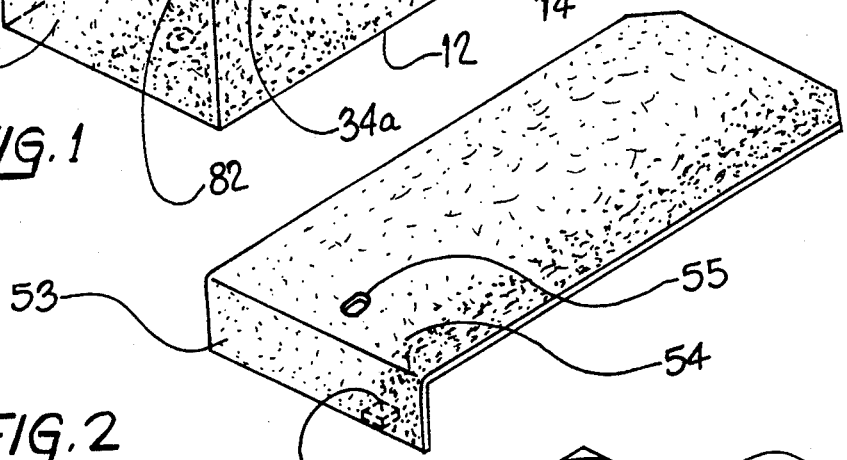
FIG. 2 is an isometric view of a slide key cover for the receptacle of FIG. 1.

Referring to FIGS. 1–9, there is shown a locking currency collector apparatus for use in combination with a Rowe currency validation apparatus comprising a replacement currency collector receptacle 10, a slide key cover 54 and an adapter bracket unit 90.

Replacement currency collector receptacle 10 has a bottom 12, sides 14, end 16, door 18 and flanges 20*a*, 20*b*, 22*a* and 22*b* at the top of each side 14. Two slide rails 24 are located at the top of each side 14 in spaced relation to flanges 20*a*, 20*b*, 22*a* and 22*b* so as to provide two coplanar slideways for slide key cover 54. Hook means 26 and 28 for a pivot bar or pivot points are located in the upper part of each side 14 adjacent to end 16. Protectors 30 and 32 are located parallel to connector means 26 and 28 and in spaced relation thereto in order to prevent removal of said fasteners for the pivot bar (not shown). Brackets 34*a* and 34*b* for the latching unit 40 are located at the top corners of sides 14 above the opening for collector door 18. Guides 38*a* and 38*b* are located at the top of each side 14 at a point between end 16 and door 18, said guides 38*a* and 38*b* being opposite each other.

Slide key cover 54 has a front flange 53 which carries cover strike 56. A slide key opening 55 is located in the center of cover 54 near the flanged end. The dimensions of the cover are selected so that the cover completely closes currency stacker receptacle 10.

Figure 3:
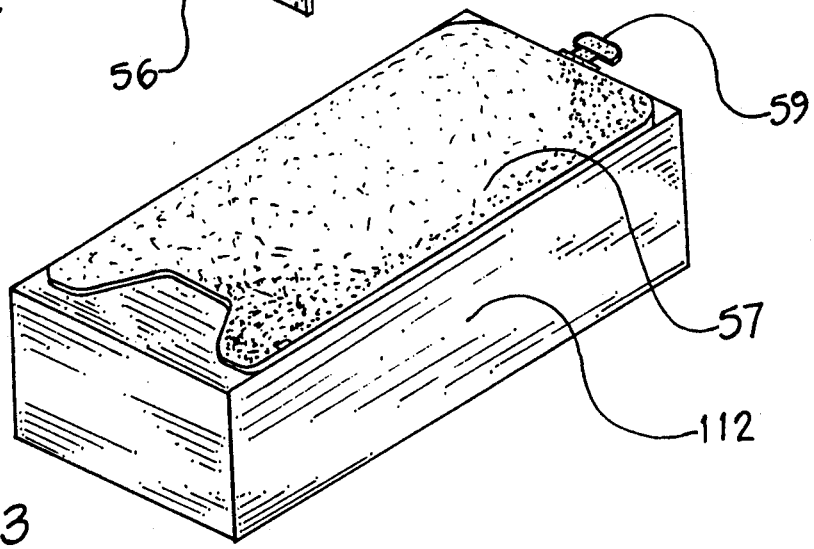
FIG. 3 is an isometric view of a follower plate on top of a foam block spring for the receptacle of FIG. 1.
Figure 4:
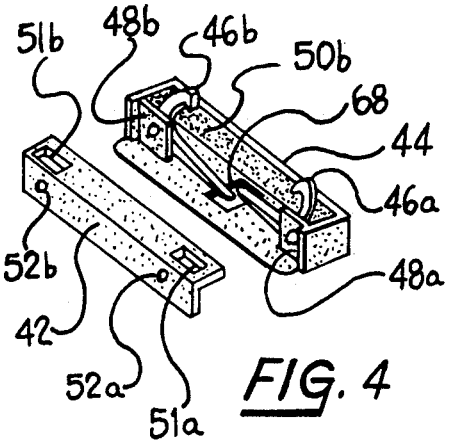
FIG. 4 is an isometric view of the collector latching means shown in FIG. 1 in a partially dismantled state.

Follower plate 57 is located within replacement currency collector unit atop spring biasing means comprising a block of resilient material, e.g., foam block spring 112 which rests upon bottom 12. As shown in FIG. 3, follower plate 57 has a detent 59, a portion of which is located in longitudinal slot 17 in end 16 and a portion of which extends beyond end 16. Said detent 59 is designed to maintain said follower plate in spaced relation to end 16.

Latching unit 40 comprises a housing formed by bracket 42—top and one side of the housing—and bracket 44—the opposite side, bottom and ends of the housing. Latching clips 46*a* and 46*b* are mounted on rivets (not shown) which pass through apertured brackets 48*a* and 48*b* attached to the ends of the latching housing and through aligned apertures 52*a* and 52*b* in bracket 42 and aligned apertures 52*c* and 52*d* (not shown) in bracket 44. The latching clips 46*a* and 46*b* are generally L-shaped with a hook at the upper or latching end—the foot of the L. The opposite ends of the latching clips 46*a* and 46*b* terminate on the center line of slide bar opening 68 in the bottom of said housing at a point intermediate the ends of said housing. Two latching clip springs 50 maintain the latching clips 46*a* and 46*b* in a latched position. Latching clips 46*a* and 46*b* protrude through openings 51*a* and 51*b* in bracket 42 after brackets 42 and 44 are joined by fasteners, e.g., rivets (not shown), passing through apertures 52*a* and 52*b* and apertures 52*c* and 52*d* (not shown) to form the latching unit. The latching clips 46*a* and 46*b* and the latching clip springs 50 also are mounted on said fasteners.

The door 18 in replacement currency collector unit 10 carries a key locking device 58 therein. Door 18 comprises a front panel 60, a top flange 62 and side flanges 64*a* and 64*b*. Hinge 68 is attached to the rear of the front panel 60 by flange 67 and the door 18 is attached to bottom 12 of replacement currency stacker receptacle by flange 66 which preferably is spot welded to said bottom 12. Four tapped brackets 70 are located on the inner surface of side flanges 64*a* and 64*b* and the apertured portion of each bracket 70 is at right angles to said sides—two on each side—in order that the rear panel of said door (not shown) can be fastened thereto by fasteners (not shown) which preferably are machine screws. Locking slide bar guide comprising upper flange 72 and lower flange 74 is mounted on the rear of front panel 60 intermediate the side flanges 64*a* and 64*b*. Upper flange 72 and lower flange 74 are parallel to top flange 62, with upper flange 72 being spaced a short distance from door flange 62 and lower flange 74 being in the lower half of front panel 60. Each of flanges 72 and 74 have a slide bar opening 78 located in the center of each flange and slide bar 76 is located therein. Locking slide bar activator 80 also is affixed to the rear of the front panel in front of opening 82. Locking slide bar activator 80 has an L-shape, with the foot of the L covering slide bar opening 79 in the top flange 62 of door 18. The top of locking slide bar 76 is maintained in contact with the foot of the L of slide bar activator 80 by extension springs 84 affixed to an aperture in the lower end of slide bar 76 and to apertures adjacent the ends of lower flange 74 of the locking slide bar guide.

FIGS. 6–9 describe an adapter bracket unit 90 which replaces the original transformer unit on the bill validation apparatus. The original transformer unit forms the end bracket on the Rowe currency validation apparatus. Adapter bracket unit 90 comprises a front plate 92 and a back plate 94 attached to transformer housing 96 which forms the front, sides and top of the adapter unit 90. Back plate 94 is fastened to the sides of the bill validation apparatus with original threaded fasteners. Front plate 92 carries attaching means 98 and back plate carries cooperating strike means 100 for the latching clips 46*a* and 46*b*.

In the embodiment depicted in FIGS. 1-9, the locking currency stacker apparatus is made of steel. In the replacement currency stacker receptacle 10, the bottom 12, sides 14, top flanges 20*a*, 20*b*, 22*a* and 22*b*, end 16 and hooks 26 and 28 for the pivot bar are integral because they are formed and shaped from a single sheet of steel. Each side rail 24 is formed from a sheet, the bottom portion of which is similar in dimensions to sides 14 and, preferably, is spot welded to side 14. Similarly, the major portion of door 18 is constructed from a single sheet of steel and the front panel 60, top flange 62 and side flanges 64 are integral. The rear panel (not shown) of door 18 and flanged hinge 68 are separate parts. Latching unit 40 and adapter bracket unit 90 also are made of steel and the manner of construction is evident from the drawings relating to said units. In the depicted embodiment, it is preferred to join the separate parts by spot welding for security purposes. Where spot welding is not appropriate, rivets or threaded fasteners such as machine screws are employed.

In use, the owner or operator must remove the original non-lockable currency collector receptacle from the currency validation apparatus. In the Rowe validation-collection unit, this is done by removing the fasteners from the pivot rod, thereby removing both the original collector and the pivot rod. The pivot rod then is replaced in its original position using fasteners. Next the original transformer unit and the original transformer bracket must be removed and adapter bracket unit 90 must be substituted therefor, preferably being attached to the currency validation unit using original metal screws. Then, the replacement currency stacker receptacle 10 may be installed by placing the pivot bar hooks 26 and 28 over the pivot bar and by swinging the collector unit 10 into locked engagement with the cooperating strike means 100 on adapter bracket unit 90 by means of latching clips 46*a* and 46*b* engaging cooperating strikes 100 carried by said adapter bracket unit 90. Foam block spring 112 and follower plate 57 are placed in the bottom of replacement currency collector receptacle 10 with detent 59 protruding through the central longitudinal opening 17 in end 16 prior to installing said collector unit 10. At this point, the currency validation/collection apparatus is ready to receive currency.

When the service person returns to the location to retrieve the currency stacker receptacle 10 which now contains currency, said person brings a replacement currency stacker receptacle 10 and a slide key cover 54. Slide key cover 54 is inserted into opening 39 between latching unit 40 and top flange 62 of door 18. When said slide key cover 54 is fully inserted, cover strike 56 passes through opening 82 to move leaf spring activator 80 rearwardly to uncover slide bar opening 79 in top flange 62 of door 18 and cause slide bar 76 to move latching clips 46*a* and 46*b* into unlatched position, thereby unlocking or unlatching replacement currency collector receptacle 10 and permitting it to be removed from the pivot bar. The slide key cover 54 cannot be removed from collector receptacle unit 10 because slide bar 76 is located in cover opening 55. The locked currency stacker receptacle can be opened by the cashier at the counting station by inserting a key into locking device 58 on door 18 to move the locking cam means 65 out of engagement with the strike for the locking device and to depress slide bar 76 by contact with the bottom of slide bar slot 77 to remove slide bar 76 from cover opening 55 and slide bar opening 79, thereby permitting cover 54 to be removed and door 18 to be opened so that the currency can be removed from the collector receptacle unit 10. Upon removal of the currency, door 18 can be closed and the key inserted in locking device 58 to rotate locking cam 65 to engage the strike for said locking device 58 to maintain the door 18 in locked position. The replacement currency stacker receptacle 10 and slide key cover 54 now are ready for reuse.

The dimensions of the replacement currency stacker receptacle 10 are variable and are determined by the size of the currency being collected and the volume of currency desired to be stored. More particularly, the preferred embodiment shown in the drawings is sized for the collection of United States paper currency, e.g., one, two, five, etc. dollar bills. Thus, the cross section of the interior currency collector unit 10 is about 2.75 inches in width and 6 $\frac{5}{8}$ inches in length. Such cross section readily accommodates United States one dollar bills which measure approximately 2 9/16 inches by 6 $\frac{1}{8}$ inches. The depth of the preferred currency collector unit 10 is four inches, but could be increased or decreased depending upon the volume of currency desired to be stored and further dependent upon the room available in the dollar bill validation vending machine. The distance between the side rails 24 in the depicted apparatus is 1 $\frac{7}{8}$ inches and is chosen to facilitate receiving and stacking the currency being collected. However, this dimension, too, is variable within limits.

Figure 5:
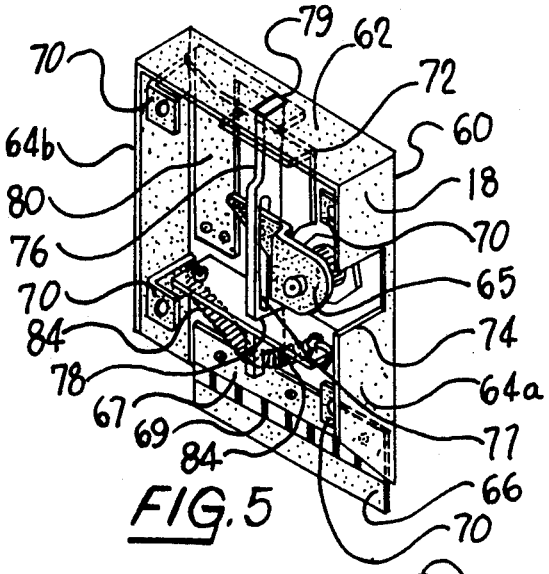
FIG. 5 is an isometric view of the inside of the door of the currency collector receptacle shown in FIG. 1 with the rear wall of the door removed.
Figure 6:
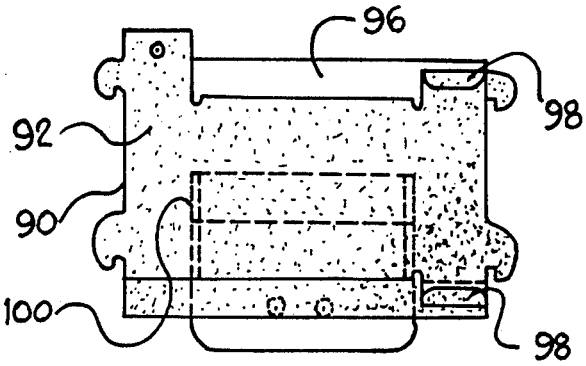
FIG. 6 is a front view of an adapter bracket unit for use with the receptacle of FIG. 1.
Figure 7:
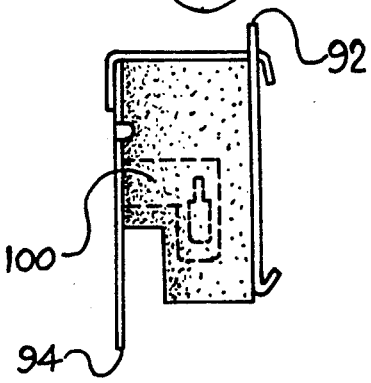
FIG. 7 is a left side view of said adapter bracket unit.
Figure 8:
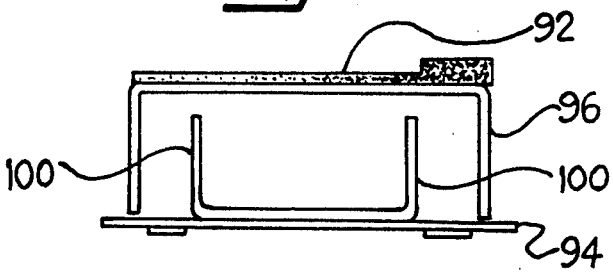
FIG. 8 is a back view of said adapter bracket unit.
Figure 9:
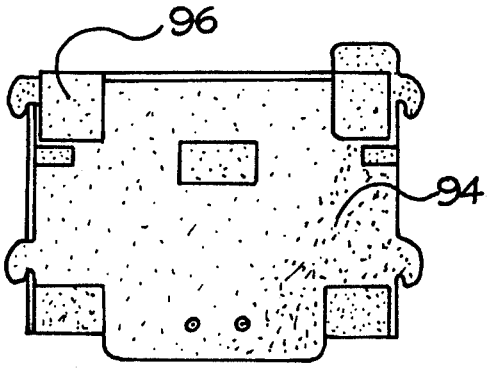
FIG. 9 is a bottom view of said adapter bracket unit.
Figure 10:
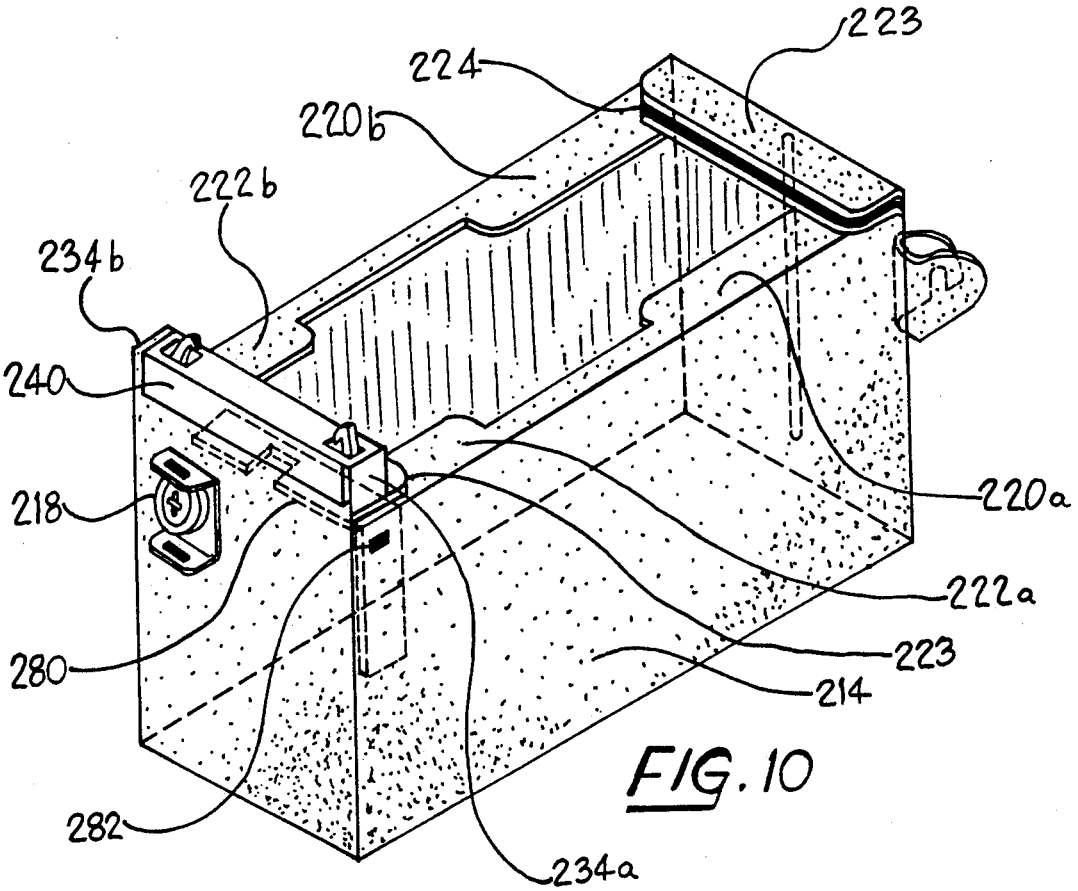
FIG. 10 is an isometric view of another embodiment of the locking currency collector apparatus without a cover wherein the slide key cover enters from the side of the unit and the slide rails are located on the ends of the receptacle.
Figure 11:
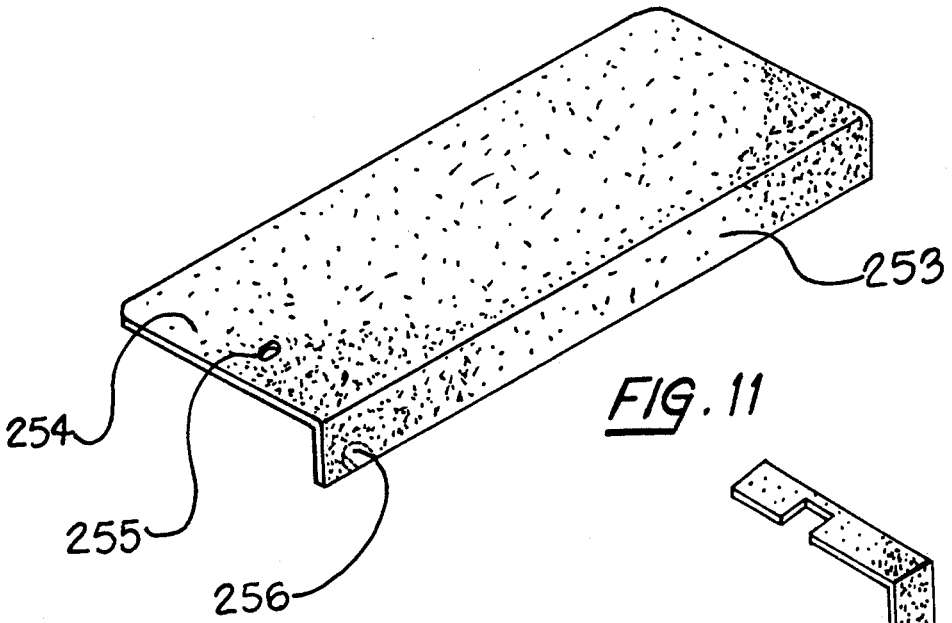
FIG. 11 is an isometric view of a cover for the receptacle of FIG. 10.
Figure 11A:
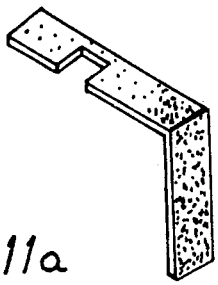
FIG. 11*a* is an isometric view of the locking slide bar actuator of FIG. 11.

FIGS. 10, 11 and 11*a* disclose another embodiment of the inventive locking currency stacker apparatus wherein the slide key cover is inserted from the side of the currency collector unit 210. In this embodiment door 18 is replaced by end 218, side rails 24 are omitted and replaced by end rails 224, guides 38*a* and 38*b* are omitted, flanges 20*a* and 20*b* are moved forward of end 216 to become flanges 220*a* and 220*b* to make room for end flanges 223 and the side 214 on which the cover 254 enters is reduced in heighth a small amount in order to provide two slideways for the slide key cover 254. In this embodiment, flange 253 on cover 254 is on the side of said cover 254 with cover strike 256 also being relocated to enter opening 282 which is in side 214. Slide bar activator 280 is located directly in front of opening 282. The configuration of slide bar activator 280 is shown in FIG. 11*a* and is such that said activator covers slide bar opening 279 until the upper portion thereof is moved to the left when the cover strike 256 contacts the leaf spring portion of said activator 280. End flange 223 is discontinuous at the end where the slide key is located, but the opposite end flange 223 is continuous. In effect, the door unit shown in FIG. 5 is modified to omit the flanged hinge and is spot welded to end 218 after forming an opening therein for locking device 258, with top flange 62 becoming end rail 224. Door locking cam 65 and the door strike therefor will be omitted because door 18 is omitted in this embodiment. Thus, access to the stacked currency will be through the top of currency collector receptacle 210 after removal of cover 254. (Although this embodiment does not contain a door, it should be recognized that the embodiment could be modified to include a door, but at an added cost.)

Figure 12:
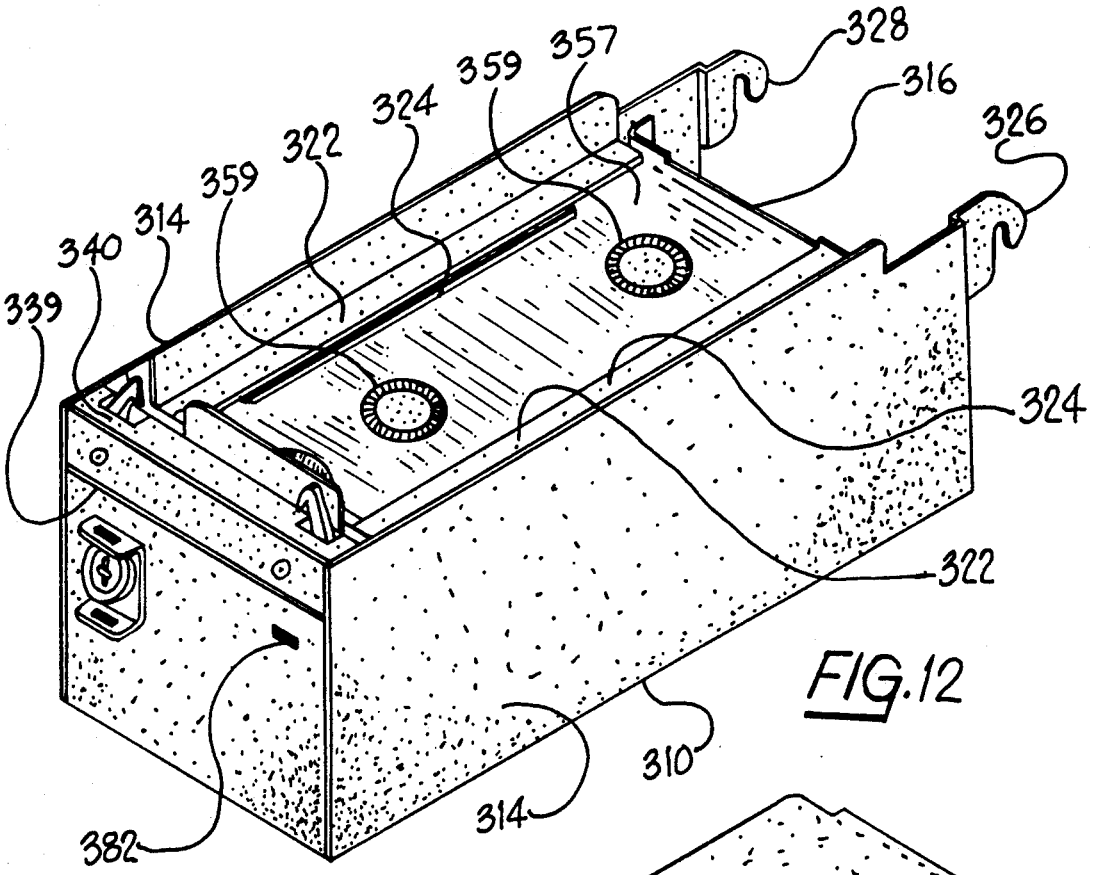
FIG. 12 is an isometric view of another embodiment of a replacement currency stacker receptacle without a cover which is particularly suitable for use with the Mars validation apparatus.

FIGS. 12–16 depict parts of a preferred currency stacker apparatus which is particularly suitable for use with the Mars currency validation apparatus. Because the latching means and the cooperating strike means on the adapter bracket for said latching means are substantially identical to those shown in FIGS. 4, 5, 7 and 8, the details thereof are not repeated. FIG. 12 is an isometric view of a currency stacker receptacle 310 wherein sides 314 have been extended upwardly so that the top of each side is coplanar with the top of the housing for latching means 340. These top extensions of the two sides function as guides for attaching the receptacle 310 to the Mars validation apparatus. Additionally, sides 314 are extended beyond the end 316 of receptacle 310 and hooks 326 and 328 are integral with sides 314, but offset inwardly from the side. Two slide rails 324 are aligned with the bottom of opening 339 and two slide rails 322 are aligned with the top of opening 339 to form the slideways for the cover 354. Follower plate 357 is located within receptacle 310 atop spring biasing means comprising two compression springs of the type shown in FIG. 15. The springs are secured to the underside of follower plate 357 and to the bottom 312 of receptacle 310. The springs provide more even pressure than the foam block spring 112 of FIG. 3 and provide more capacity than the foam block spring because the foam block spring produces more back pressure as the receptacle is filled with currency, thereby reducing the effective capacity of the receptacle. Furthermore, the two springs fix the position of the follower plate 357 and eliminate the need for the detent 59 and cooperating longitudinal slot 17 shown in FIG. 1.

Figure 13:
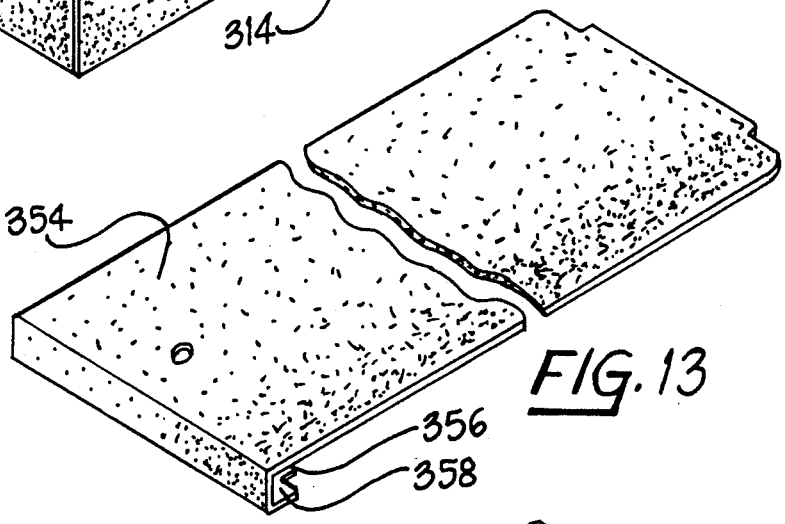
FIG. 13 is an isometric view of a cover for the receptacle of FIG. 12.

FIG. 13 shows an isometric view of the cover 354 for receptacle 310. Cover 354 is similar in shape to cover 54 of FIG. 2. However, the end opposite the flanged end which is extended a small distance in the center portion to the cover to extend to the rear surface of end 316 thereby closing a major portion of the opening where the cover 354 meets the inside surface of end 316. The change in shape facilitates covering of the open portion of receptacle 310. Furthermore, the flanged end of cover 354 has a lower flange 358 which is coplanar with cover strike 356. Lower flange 356 makes it easier to grip the slide key cover 354 for removal of the cover.

The cover plate 357 also differs slightly in shape from the cover plate 57 of FIG. 3. Further, the circular areas 359 adjacent the top of the springs shown in FIG. 15 are slightly depressed below the top surface of said cover plate 357.

Figure 14:
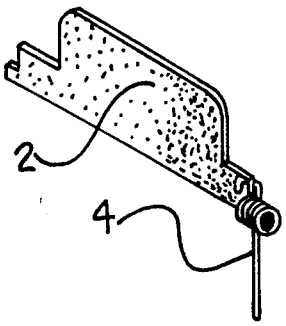
FIG. 14 is an isometric view of a currency depressor for the receptacle of FIG. 12.

FIG. 14 depicts a currency depressor 2 and spring 4. Currency depressor 2 is affixed to receptacle 310 immediately adjacent to the rear of latching unit 340 so that it is disposed across opening 339 for slide key cover 354. In operation, when slide key cover 354 is inserted to close receptacle 310, it causes bill depressor 2 to rotate downwardly 90 degrees, thereby depressing the end of the stacked currency in receptacle 310. Currency depressor 2 is required for the Mars currency validation apparatus because the operation and design of its plunger unit results in the end of the stacked currency being slightly raised and the raised currency interferes with insertion of slide key cover 310.

Figure 15:
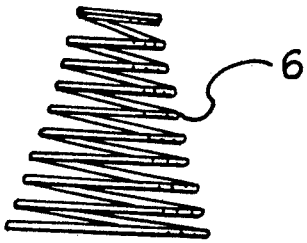
FIG. 15 is a front view of a compression spring.

FIG. 15 discloses a spring 6 which is employed in supporting cover plate 357. A pair of springs 6 is employed, with the top of each spring 6 being secured to the underside of circular areas 359 and the bottom of each spring 6 being secured to the bottom 312 of receptacle 310 by suitable means such as raised brackets which are not shown.

Figure 16:
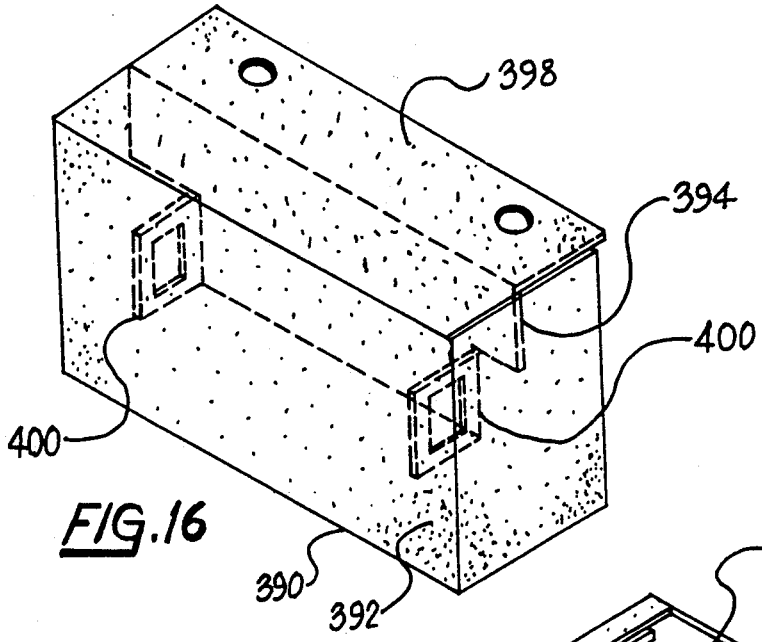
FIG. 16 is an isometric view of an adapter bracket unit suitable for use in conjunction with the receptacle of FIG. 12.

FIG. 16 shows an isometric view of adapter bracket unit 390 which is attached to the Mars currency validation apparatus. Adapter bracket unit 390 includes a top plate 398 with openings therein for threaded fasteners to attach the unit to the Mars currency validation apparatus. Cooperating strike means 400 are affixed to back plate 394 and the top 398, back plate 394 and cooperating strikes 400 are integral. Front plate 392 and the ends of said adapter bracket unit 390 are integral.

As mentioned above, the remaining details of the embodiment show in FIGS. 12 and 13 are the same as for the embodiment in FIGS. 1–9 and, therefore, this embodiment functions similarly in use.

Figure 17:
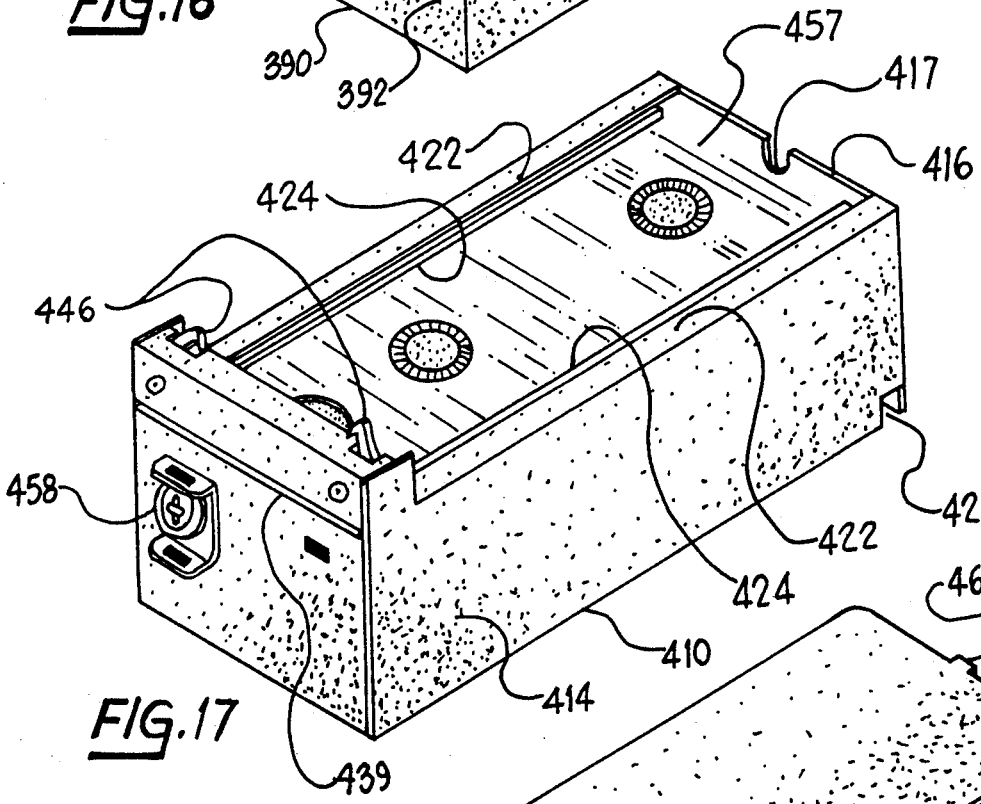
FIG. 17 is an isometric view of another embodiment of a replacement currency stacker receptacle without a cover which is particularly suitable for use with the Dixie validation apparatus.
Figure 18:
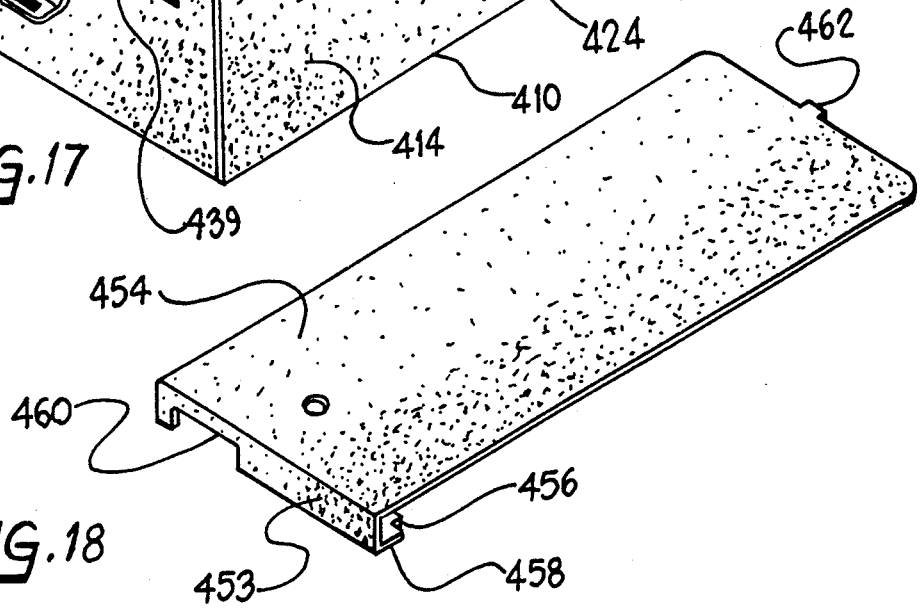
FIG. 18 is an isometric view of a cover for the receptacle of FIG. 17.

FIGS. 17 and 18 describe the receptacle and cover parts of another embodiment of the inventive currency stacker apparatus which is particularly suitable for use with the Dixie currency validation apparatus. Only these parts are illustrated because the latching means, cooperating strike means and the means for locking-unlocking the cover are essentially identical to those described heretofore. FIG. 17 is an isometric view of a currency stacker receptacle wherein sides 414 have the same heighth as sides 14 in FIG. 1. Also, top slide rails 422 are integral with each side 414, the bottom of said top slide rails 422 being coplanar with the top of cover opening 439. As shown, the top side rails 422 run substantially the full length of sides 414. Again, top slide rails 422 and bottom slide rails 424 form two slideways for cover 454. In receptacle 410, the hook means comprise an open channel 427 in front of the lower edge of end 416. Channel 427 is integral with end 416 and is spot welded to an upstanding flange on the bottom 412 of receptacle 410 to completely close the bottom portion thereof. An opening 417 is shown at the center of the upper edge of end 416 of the receptacle 410. Opening 417 is required to provide space for a counter mounted on the Dixie currency validation apparatus. Follower plate 457 is similar in shape to follower plate 357 and also is secured to the bottom of receptacle 410 by two compression springs 6 which provide back pressure on said plate as the currency is stacked therein.

Cover 454 of FIG. 18 is similar in design to the cover shown in FIG. 13. Detent 462 covers the opening 417 when the cover is fully seated on receptacle 410. Flange 458 only extends about twenty-five percent of the width of cover 454 and cover strike 456 extends from the front of flange 458. A cut out 460 in front flange 453 is required so that said flange clears the top of key locking device 458 when the cover 454 is fully seated.

The inventive locking currency stacker apparatus operates in the same manner as the apparatus described in FIGS. 1–9. More specifically, the hooking channel of the uncovered receptacle 410 is placed over the provided pivot bar on the Dixie currency validation apparatus and the opposite end thereof is raised until latching clips 446 engage the cooperating strikes on the adapter bracket unit which had been prior attached to the Dixie validation apparatus. After currency is received from the validation apparatus through reciprocation of the plunger and stacked in the receptacle, the receptacle 410 is removed by inserting cover 454 into opening 439 and fully seating said cover 454 in the slideway to simultaneously lock the cover in place and release latching clips 446 from the cooperating strikes, thereby causing one end of the locked receptacle 410 to swing free of the Dixie currency validation apparatus.

The locked receptacle 410 is then removed by disengaging the opposite end from the pivot bar on the validation unit.

Figure 19:
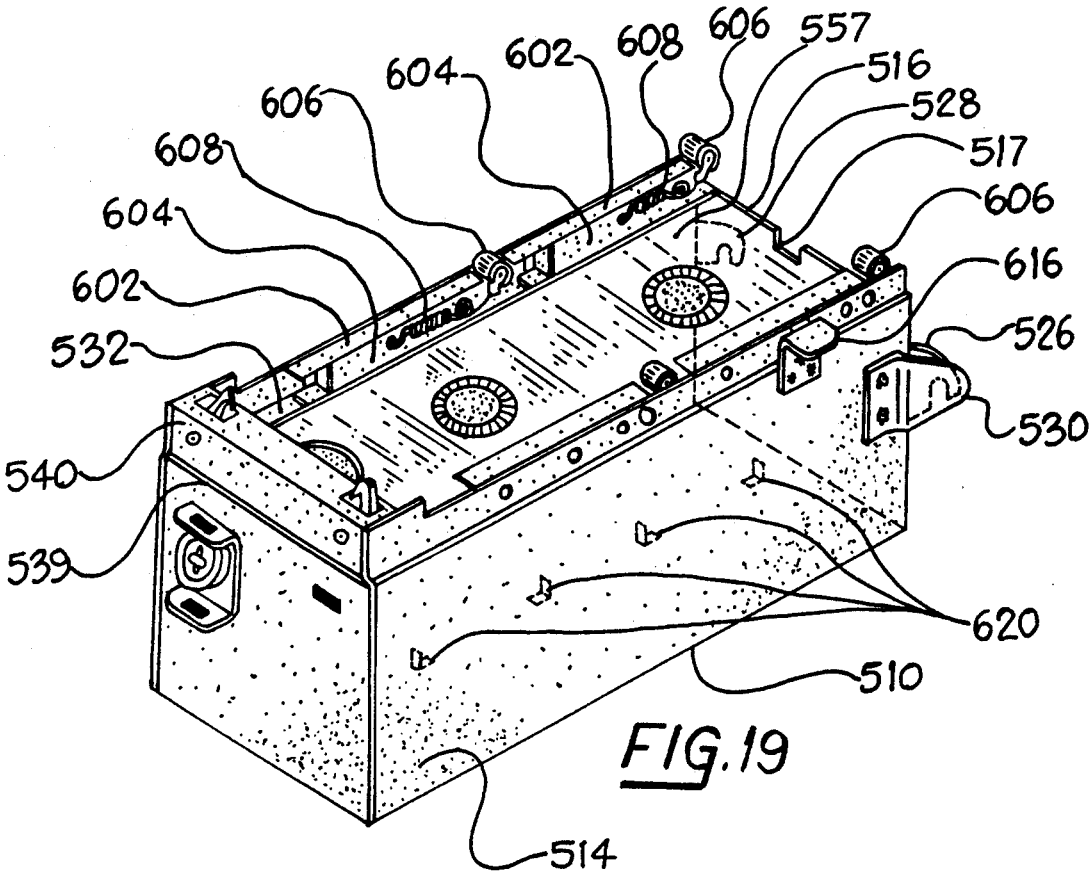
FIG. 19 is an isometric view of another embodiment of a replacement currency stacker receptacle without a cover which is particularly suitable for use with the Maka validation apparatus.
Figure 20:
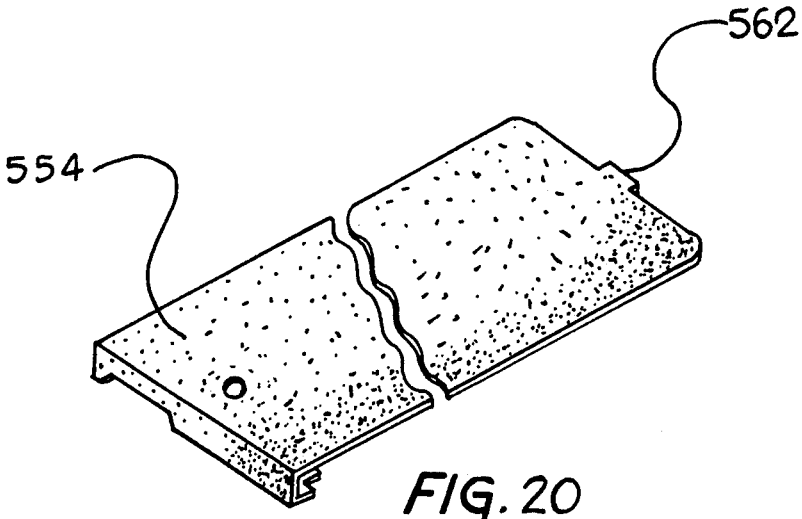
FIG. 20 is an isometric view of a cover for the receptacle of FIG. 19.

FIGS. 19 and 20 show the receptacle and cover parts of a further embodiment of the inventive currency stacker apparatus which is particularly suitable for use in combination with the Maka currency validation apparatus. Once again, only the receptacle and cover parts are illustrated because the remaining portions of the inventive apparatus are substantially identical to the parts described heretofore. FIG. 19 is an isometric view of a currency stacker receptacle 510 wherein the top of sides 514 terminates below the top of latching unit 540, with the portion of side 514 above the bottom of cover opening 539 being offset inwardly. Hooks 526 and 528 also are offset inwardly from sides 514, but are integral therewith. Receptacle 510 includes protectors 530 and 532(not shown) to cover the ends of the pivot points—not a solid pivot bar—of the Maka currency validation apparatus in order to protect against removal of the fasteners holding said pivot points. Like receptacle 310, the slideways of receptacle 510 are formed of right angle brackets spot welded to the inside of side walls 514. The slide rails are coplanar with the top and bottom of cover opening 539. Further, the plastic lower guides of the currency feed part of the Maka currency validation apparatus which are located adjacent to the currency transfer passage are removed from said apparatus and reinstalled on top of side rails 532. The lower currency guides of the Maka comprise an upper plastic slide 602 and a lower plastic slide 604 separated by unnumbered dividers or spacers. The slides 602 are interrupted by plastic rollers 606 tensioned by springs 608 affixed to said slides. These lower currency guides are mounted at the tops of sides 514 by gasteners which are not shown. Follower plate 557 is of the same design as follower plate 357 of FIG. 13 and is located atop compression springs of the type shown in FIG. 15. The compression springs are affixed to the bottom receptacle 510 by locator brackets 620. Microswitch bracket 616 is spot welded to the top of one side 514 in cooperating relationship with an microswitch on the Maka validation apparatus. The microswitch bracket 616 is required to engage a microswitch on the Maka validation apparatus which insures the presence of the stacker receptacle before the Maka validation apparatus is placed in operation and is a safety feature. Opening 517 in the top center of end 516 is required to accommodate a counter located on the Maka validation apparatus and detent 562 on cover 554 covers said opening when the cover 554 is fully seated in the slideways.

Cover 554 is of the same design as cover 454.

In operation, the embodiments described in FIGS. 12–20 operate in the same manner as the embodiment shown in FIGS. 1–9. More particularly, first the adapter bracket unit with cooperating strike means is installed on the specified currency validation apparatus adjacent the end of the currency transfer passage opposite the end with the pivot means. Then the uncovered receptacle is hooked to the pivot means and latched to the currency validation apparatus by means of latching clips engaging the cooperating strikes on the adapter bracket unit. Currency is inserted into the currency acceptor and validation unit, moved to the currency validation unit and thereafter valid currency is moved to the area in front of the plunger and above the transfer passage through which it is transferred by the plunger to the receptacle of the inventive currency stacker apparatus. In the Rowe and Mars acceptor-validator apparatus, currency is moved by means of two moving belts, with a short belt on the bottom. In the Dixie and Maka acceptor-validator units, currency is fed between an upper moving belt and a stationary lower plastic guide. In the Maka, tensioned plastic rollers are placed at strategic points in the plastic guide.

While the preferred embodiments of the described inventive apparatus are made of steel for strength, wear resistance and ease of fabrication, said apparatus may be made of other metals or impact-resistant plastic resins. Other suitable metals are aluminum, magnesium, zinc and alloys thereof. Suitable plastic materials include both thermosetting and thermoplastic resins having high impact resistance. Satisfactory thermoplastic resins include cellulose acetate, cellulose acetate butyrate, nylon, polycarbonate, polyethylene, polypropylene, tetrafluorethylene and vinylidene chloride resins. Satisfactory thermosetting resins include epoxy, polyester and silicone resins. Use of plastic materials is advantageous because the apparatus weighs less and is easier to handle. However, plastic materials have less strength than metals. In fabricating the parts of the locking currency collector apparatus, the various materials may be stamped, cast, molded or drawn, with the particular fabricating technique varying according to the material being processed. Further, various means may be used to join or fasten together the individual parts of the inventive collector apparatus. In the illustrated preferred embodiments spot welding, rivets and threaded fasteners have been employed to make it difficult to disassemble the currency collector apparatus.

In the preferred locking currency stacker apparatus, the most preferred spring biasing means are the compression springs. However, the rectangular block of resilient material may be substituted therefor when capacity is not important. Said block typically is made of foam-type plastic and its length and width are slightly greater than the length and width of the currency being stacked, with the overall heighth being slightly greater than the overall heighth of the receptacle. Thus the block must be compressed in order to enable the restorative forces within the block to urge the supporting plate upwardly toward the bottom of the lower slide rails.

This invention has been described with reference to preferred embodiments, but it is not intended that the particular embodiments shall be a limitation on the scope of the invention. It will be obvious to those skilled in the are that other obvious modifications and variations of the invention can be made without departing from the principles disclosed.

What is claimed is:

1. Locking currency stacker apparatus for use in conjunction with currency validation apparatus having a plunger for transferring currency through a passage into a currency receptacle and including a pivot means adjacent to one end of the passage which comprises (a) an open currency receptacle having a slideway for a cover adjacent the opening; (b) a separate cover for said receptacle having a detent thereon to actuate latching means to a latched position; (c) means for locking said cover on said receptacle and for unlocking same therefrom; (d) means for removably attaching said receptacle to the currency validation apparatus which comprise (1) hook means on said receptacle for pivot means on said currency validation apparatus and (2) latching means on said receptacle; and (e) an adapter bracket unit which includes cooperating strike means for said latching means and is attachable to the currency validation apparatus adjacent to the other end of the passage; whereby the step of closing said receptacle by seating said cover in the slideway of said receptacle simultaneously locks said cover on the receptacle and unlatches one end of the locked currency receptacle from the currency validation apparatus so that said locked currency receptacle may be removed therefrom by disengaging the hook means from the pivot means.

2. A locking currency stacker apparatus according to claim 1 wherein said means for locking and unlocking said cover includes a movable slide bar located on said receptacle.

3. A locking currency stacker apparatus according to claim 2 which further includes a follower plate and compression spring means within said receptacle for biasing said follower plate toward the open end of said receptacle to facilitate stacking said currency.

4. A locking currency stacker apparatus according to claim 1 wherein said receptacle further includes a protector which covers an end of the pivot means fastened to the currency validation apparatus with an exposed fastener, thereby deterring removal of said pivot means.

5. A locking currency collector apparatus according to claim 3 which further includes a door at one end of said receptacle, said door having a key operated locking device thereon for locking and unlocking said door.

6. A locking currency stacker apparatus according to claim 3 wherein said spring means consists of a pair of springs affixed to the bottom of said receptacle and to the bottom of said follower plate.

7. A locking currency stacker apparatus according to claim 3 wherein said spring means consists of a block of resilient, foam-type plastic.

8. A locking currency stacker apparatus according to claim 5 wherein said receptacle further includes protectors which cover both ends of the pivot means contained on the currency validation apparatus and a longitudinal slot in the center of the end opposite the end with the door, said follower plate has a detent at one end which cooperates with said longitudinal slot to maintain said follower plate in a fixed position, said pivot means is a pivot bar and said door consists of a hinged end of said receptacle.

9. A locking currency stacker apparatus according to claim 8 wherein said spring means consists of a pair of springs affixed to the bottom of said receptacle and to the bottom of said follower plate.

10. A locking currency stacker apparatus according to claim 5 wherein said receptacle further includes a bill depressor unit affixed immediately adjacent the rear of the latching unit and in front of the slide cover opening in said receptacle, said pivot means is a pivot bar contained on the currency validation apparatus, the top of each side is coplanar with the top of the latching housing, the adapter bracket also serves as an endplate on said bill validation apparatus and said door consists of a hinged end of said receptacle.

11. A locking currency stacker apparatus according to claim 10 wherein said spring means consists of a pair of springs affixed to the bottom of said receptacle and to the bottom of said follower plate.

12. A locking currency stacker apparatus according to claim 11 wherein said cover includes a flange coplanar with the detent thereon to displace the front flange from said receptacle whereby movement of said cover is facilitated.

13. A locking currency stacker apparatus according to claim 5 wherein said hook means consists of an open channel in front of the lower edge of the end of said receptacle opposite the end which includes said door, said door consists of a hinged end of said receptacle and said pivot means is a pivot bar added to the currency validation apparatus.

14. A locking currency stacker apparatus according to claim 13 wherein said spring means consists of a pair of springs affixed to the bottom of said receptacle and to the bottom of said follower plate.

15. A locking currency stacker apparatus according to claim 14 wherein said cover includes a flange coplanar with the detent thereon to displace the front flange of said cover from said receptacle whereby movement of said cover is facilitated.

16. A locking currency stacker apparatus according to claim 5 wherein said pivot means consist of two pivot points contained on the currency validation apparatus and said receptacle further includes plastic currency guides and tensioned plastic rollers mounted on a flange on top of the side rails on said receptacle and adjacent the currency transfer passage and a microswitch bracket whereby said guides and rollers function to move currency in the validation apparatus and the microswitch engages a cooperating contact on the currency validation apparatus to signify that said receptacle is in operating position.

17. A locking currency stacker apparatus according to claim 16 wherein said spring means consists of a pair of springs affixed to the bottom of said receptacle and to the bottom of said follower plate.

18. A locking currency stacker apparatus according to claim 17 wherein said cover includes a flange coplanar with the detent thereon to displace the front flange of said cover from said receptacle whereby opening and closing said cover is facilitated.

19. A method of converting currency validation and collection apparatus having a plunger for transferring currency from the validator to the collector and including pivot means adjacent to one end of the passage through which the currency is transferred from use of an unlocked currency receptacle to a locking currency receptacle comprising the steps of: (A) removing the original unlockable currency receptacle from the validation and collection apparatus; (B) attaching an adapter bracket unit having cooperating strike means thereon to the validation apparatus adjacent the end of the currency transfer passage opposite the end thereof adjacent to the pivot means; and (C) installing thereon an open replacement currency receptacle having (1) a slideway adjacent the opening, (2) a separate cover, (3) means for locking and unlocking said cover on the receptacle and (4) means for removably attaching said receptacle to said currency validation apparatus which comprise hook means for pivot means on said validation apparatus and latching means which cooperate with said strike means to latch said receptacle to said validation apparatus; whereby the step of closing said receptacle by seating said cover in the slideway of said receptacle simultaneously locks said cover on the receptacle and unlatches one end of the locked currency receptacle from the currency validation apparatus so that said locked currency receptacle may be removed therefrom by disengaging the hook means from the pivot means.

* * * * *